US011021868B2

(12) United States Patent
Shin

(10) Patent No.: US 11,021,868 B2
(45) Date of Patent: Jun. 1, 2021

(54) FINISHING PANEL FIXING DEVICE

(71) Applicant: JOEUN-DECO CO., LTD, Jeollanam-do (KR)

(72) Inventor: Jung Kang Shin, Jeollanam-do (KR)

(73) Assignee: JOEUN-DECO CO., LTD, Jeollanam-Do (KR)

( * ) Notice: Subject to any disclaimer, the term of this patent is extended or adjusted under 35 U.S.C. 154(b) by 0 days.

(21) Appl. No.: 16/495,844

(22) PCT Filed: Mar. 19, 2018

(86) PCT No.: PCT/KR2018/003159
§ 371 (c)(1),
(2) Date: Sep. 20, 2019

(87) PCT Pub. No.: WO2018/174488
PCT Pub. Date: Sep. 27, 2018

(65) Prior Publication Data

US 2020/0048894 A1 Feb. 13, 2020

(30) Foreign Application Priority Data

Mar. 21, 2017 (KR) ..... 10-2017-0035566

(51) Int. Cl.
*E04B 2/00* (2006.01)
*E04B 1/41* (2006.01)
(Continued)

(52) U.S. Cl.
CPC ..... *E04B 1/40* (2013.01); *E04F 13/081* (2013.01); *E04B 2001/405* (2013.01)

(58) Field of Classification Search
CPC ..... E04B 9/26; E04B 1/40; E04B 2001/405; E04F 13/0812; E04F 13/0821;
(Continued)

(56) References Cited

U.S. PATENT DOCUMENTS 4,633,635 A 1/1987 Anderson
5,186,517 A * 2/1993 Gilmore ..... B60R 11/00 24/295
(Continued)

FOREIGN PATENT DOCUMENTS

KR 20/0268847 Y1 3/2002
KR 10-1234675 B1 2/2013
(Continued)

OTHER PUBLICATIONS

International Search Report dated Jul. 27, 2018 in related International Patent Application No, PCT/KR2018/003159.
(Continued)

*Primary Examiner* — Chi Q Nguyen
(74) *Attorney, Agent, or Firm* — Eric L. Lane; Green Patent Law

(57) ABSTRACT

The present invention relates to a finishing panel fixing device, and more particularly, to a finishing panel fixing device that fixes a finishing panel so that the finishing panel can be stably fixed when installing the finishing panel for finishing an indoor or outdoor wall surface or a floor. The finishing panel fixing device according to the present invention is extremely simple to assemble and install, and thus can reduce the time required for assembly, installation, and disassembly. The finishing panel fixing device also enhances fixability with respect to the finishing panel so that movement of the finishing panel due to an external force is prevented, and thus can also be applied to the finishing of an outdoor wall. The finishing panel fixing device can also facilitate maintenance.

6 Claims, 10 Drawing Sheets

(51) Int. Cl.
*E04F 13/08* (2006.01)
*E04B 1/38* (2006.01)

(58) Field of Classification Search
CPC ... E04F 13/081; E04F 13/0814; E04F 13/083; E04C 3/08; E04C 5/18; E04C 5/16
USPC .... 52/506.09, 506.08, 713, 712, 715, 489.1, 52/489.2
See application file for complete search history.

(56) References Cited

U.S. PATENT DOCUMENTS 5,375,798 A * 12/1994 Hungerford, Jr. ..... F16L 3/243 248/58
5,408,796 A * 4/1995 Hashimoto ..... E04B 2/7409 52/481.2
5,517,731 A * 5/1996 Spykerman ..... B60R 13/0206 24/295
5,737,887 A * 4/1998 Smeenge ..... E04B 2/7425 160/135
6,336,302 B1 * 1/2002 Brugman ..... E04B 9/26 52/483.1
6,684,929 B2 * 2/2004 MacDonald ..... E04B 2/7425 160/135
7,461,484 B2 * 12/2008 Battey ..... E04B 2/7425 52/220.7
7,562,857 B2 * 7/2009 Nagai ..... F16B 5/0664 248/222.12
8,672,600 B2 * 3/2014 Reznar ..... E04F 15/04 411/457
9,086,086 B2 * 7/2015 Bentrim ..... F16B 21/20
10,131,290 B2 * 11/2018 Harvey ..... F16B 5/0621
10,323,669 B2 * 6/2019 Lamouche ..... B65D 19/14
2006/0099051 A1 * 5/2006 Moerke ..... F16B 19/008 411/508
2008/0289155 A1 * 11/2008 Kim ..... F16B 37/043 24/295
2010/0025545 A1 * 2/2010 Koval ..... B61L 1/187 246/107
2012/0317757 A1 * 12/2012 Risdale ..... B29C 45/1635 24/458
2016/0138629 A1 * 5/2016 Flynn ..... F16B 19/1081 411/57.1

FOREIGN PATENT DOCUMENTS

KR 10-1639273 B1 7/2016
KR 10-1709747 B1 2/2017

OTHER PUBLICATIONS

Written Opinion in related International Patent Application No. PCT/KR2018/003159.

* cited by examiner

FINISHING PANEL FIXING DEVICE

TECHNICAL FIELD

The present invention relates to a finishing panel fixing device, and more specifically, to a finishing panel fixing device which allows a finishing panel to be stably and simply installed when the finishing panel for finishing an indoor or outdoor wall or an indoor or outdoor floor is installed.

BACKGROUND ART

Generally, finishing work is performed on surfaces of wall structures to beautifully decorate exterior walls of buildings that are exposed to the outside. In the wall finishing work, various finishing methods are known and performed conventionally, and recently, a construction method that attaches finishing panels to walls of a building consecutively has been widely used as a method of finishing a building wall, wherein the finishing panel is formed of a material, such as natural stone, artificial stone, a metal plate, a synthetic resin plate, and a wooden board, in a rectangular shape and a predetermined size.

As an example of related technology for assembling and disassembling a finishing panel and mounting a finishing panel to a wall of a structure, "Construction Structure of Decorative Panel of Building and Construction Method Thereof" is disclosed in Korean Laid-open Patent Application No. 10-2005-0104117.

The construction structure of a decorative panel of a building and the construction method thereof are formed to include a panel fixing device which is installed on a wall of a building and adjusts a gap between the wall and a decorative panel, a fastening groove that is formed in a front surface of the panel fixing device, on which a decorative panel is installed, and that has an open upper portion, and a fastening unit installed on a rear surface of the decorative panel and fastened in the fastening groove to prevent the decorative panel from moving.

In the conventional construction structure of a decorative panel of a structure and the construction method thereof, a wall surface of the constructed decorative panel is even without unevenness. However, a great deal of time for assembling and disassembling is required due to a complicated assembling process in which as many fixing angles should be installed on a wall of a building as decorative panels to be constructed, fixing brackets should be assembled to the fixing angles using bolts and nuts one by one, and the decorative panel is assembled to the fixing brackets using bolts and nuts, and thus there is a problem of low effectiveness.

To solve the problem, "Wall Structure" is disclosed in Korean Laid-open Patent Application No. 10-2009-0053661, wherein the wall structure includes a fixing frame which is fixed to a concrete wall and includes a plurality of lateral bars and a plurality of vertical bars that are integrally formed, a finishing panel which is disposed on the lateral bars and the vertical bars to finish the concrete wall and includes a flat plate and an elastic piece bent from the plate toward a rear side of the plate, a fastened unit provided on any one of the fixing frame and the finishing panel, and a fastening unit provided on the other one thereof and fastened in the fastened unit to be coupled thereto.

The wall structure has an advantage of being simply assembled and disassembled, but the fastened units for the finishing panel should each be installed on the fixing frames, and particularly, the finishing panel is not fixed while being mounted on the fixing frame by the fastened unit, and thus there is a problem in that the finishing panel is easily separated or disassembled from the fastened unit of the fixing frame due to an external factor.

DISCLOSURE

Technical Problem

The present invention is directed to providing a finishing panel fixing device which reduces assembling and disassembling time due to a simple assembling process and increases a fixing performance for a finishing panel to prevent the finishing panel from moving due to an external force so as to be easily maintained.

Technical Solution

One aspect of the present invention provides a finishing panel fixing device which includes a base which is coupled to a support frame fixedly installed on a wall or a floor so that a finishing panel is installed on the wall or the floor and a gripping clip of which one side is coupled to the base and the other side serves to grip the finishing panel.

The base may include a mounting plate, which has a mounting hole vertically passing therethrough so that the gripping clip is inserted thereinto upward from a lower side of the mounting plate and mounted, and a reinforcing plate coupled to the lower side of the mounting plate to prevent the gripping clip from being extracted downward from the mounting plate and supports the gripping clip.

The mounting plate may include a withdrawal preventing protrusion that extends upward from an upper surface of the mounting plate around the mounting hole to be inclined so as to prevent the gripping clip from being extracted upward from the mounting plate and restricts the gripping clip.

The mounting plate may include a withdrawal prevention groove which is recessed upward from a lower surface of the mounting plate around the mounting hole to prevent the gripping clip from being extracted upward from the mounting plate and allows a part of the gripping clip to enter thereinto.

The base may further include a coupling part for coupling the reinforcing plate with the mounting plate, wherein the coupling part includes a plurality of coupling protrusions protruding upward from an upper surface of the reinforcing plate and a coupling hole vertically passing through the mounting plate so that each of the coupling protrusions passes therethrough.

The base may further include an elastic part that elastically supports the gripping clip from a lower side of the gripping clip.

The elastic part may include an elastic piece formed by cutting a part of the reinforcing plate disposed below the gripping clip and bending the cut part upward.

The elastic part may be deformed when an external force is applied and return to an original state when the external force is removed.

The gripping clip may be provided as a plurality of gripping clips disposed adjacent to each other, and each of the gripping clips includes a first vertical part and a second vertical part that are vertically disposed on the base to be perpendicular to the base and bent to be perpendicular to each other, a first pressing rib and a second pressing rib that extend from upper end portions of the first and second vertical parts to increase distances from the first and second vertical parts and press side surfaces of skirt parts, and a first lateral part and a second lateral part that extend from lower end portions of the first and second vertical parts to increase distances from the first and second vertical parts and are supported to be pressed against the base.

The finishing panel fixing device may further include a fixing part configured to fix the gripping clip to the base, wherein the fixing part includes a fastening member passing through the first lateral part or the second lateral part and fastened to the base.

Advantageous Effects

A finishing panel fixing device according to the present invention is very conveniently assembled and installed to reduce time for assembling, installing, and disassembling, can be applied to external wall finishing by increasing a fixing performance for the finishing panel to prevent the finishing panel from moving due to an external force, and can be easily maintained.

DETAILED DESCRIPTION

Figure 1:
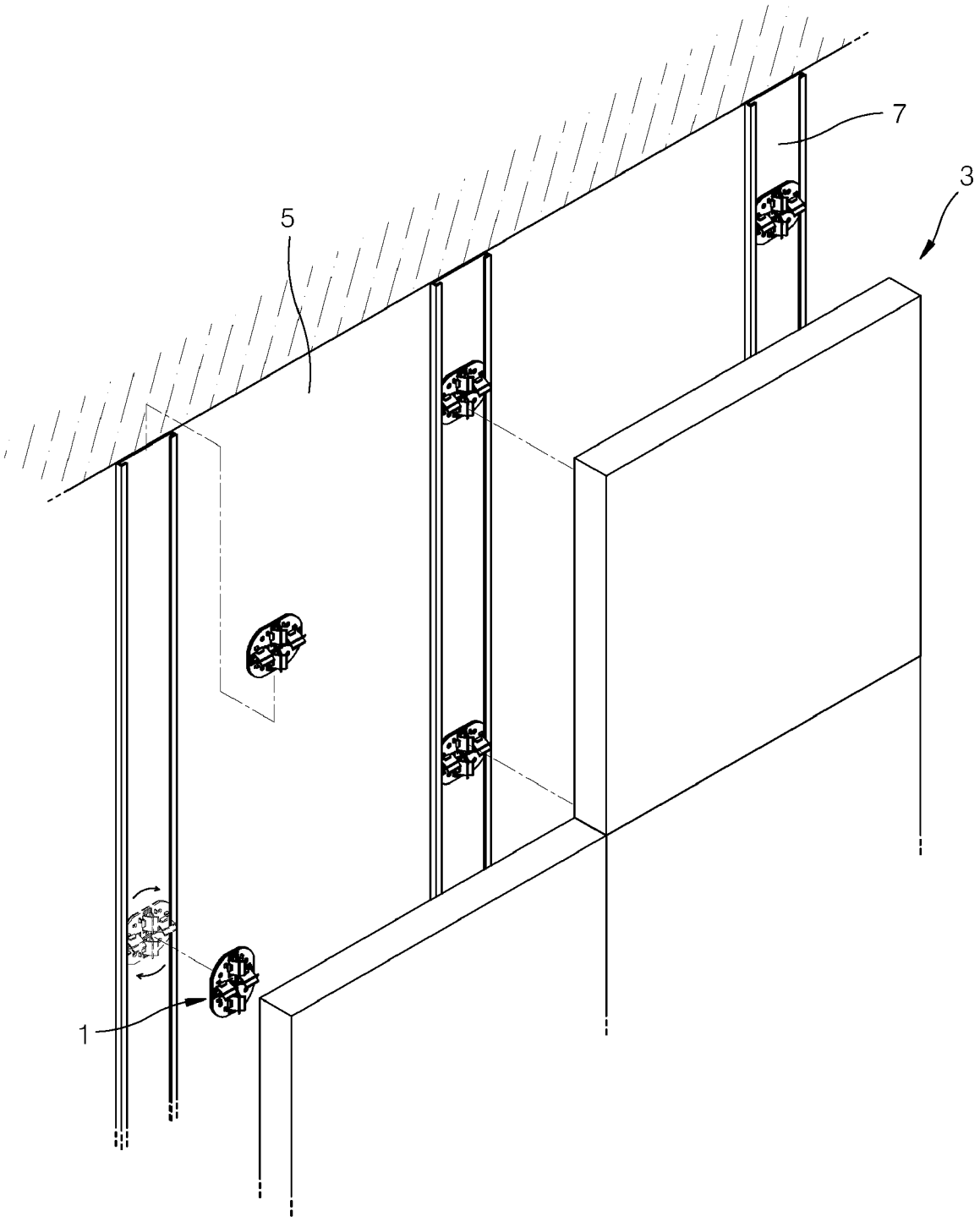
FIG. 1 is an exploded perspective view illustrating an example in which a finishing panel fixing device according to one embodiment of the present invention is used for wall finishing.
Figure 2:
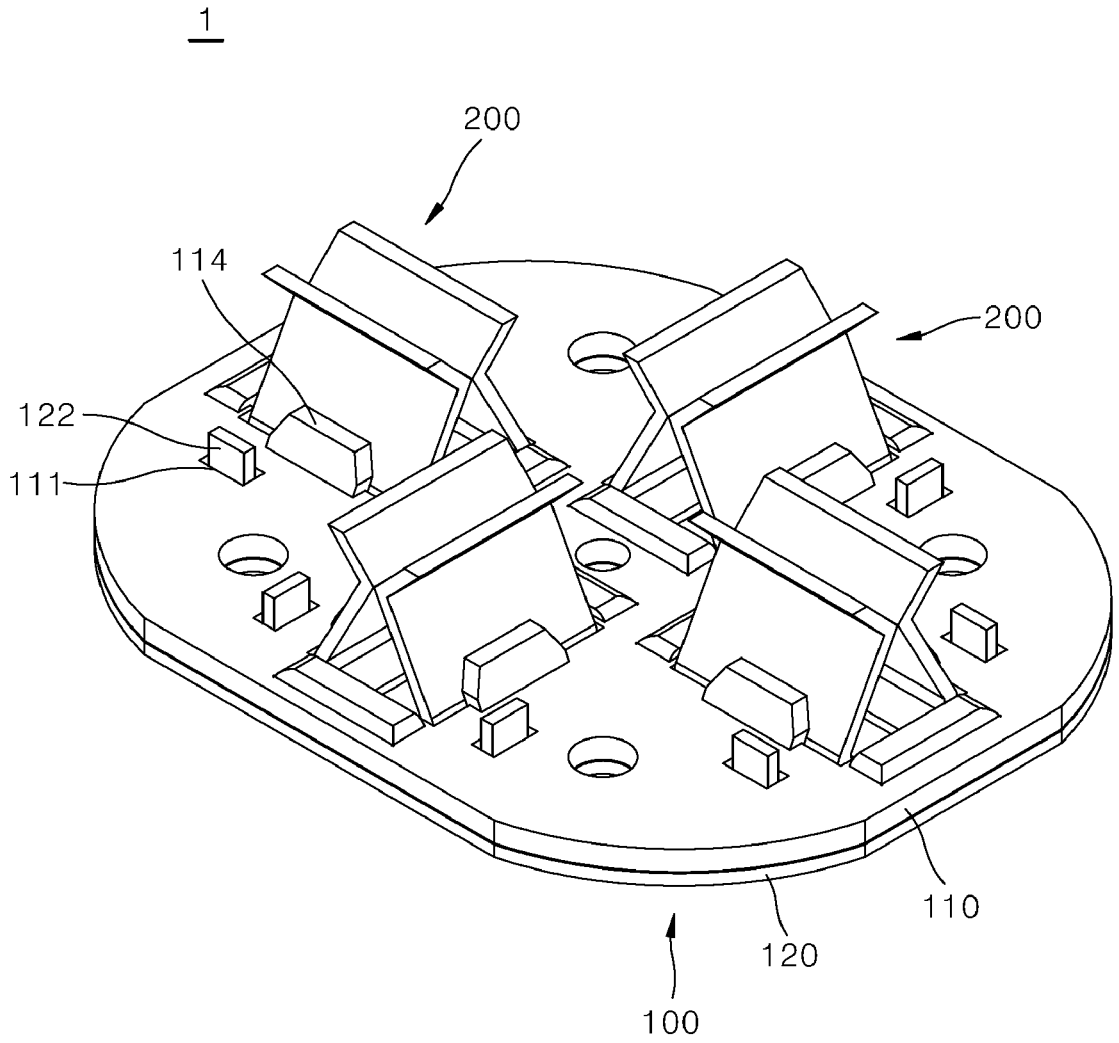
FIG. 2 is a perspective view of the finishing panel fixing device illustrated in FIG. 1.
Figure 3:
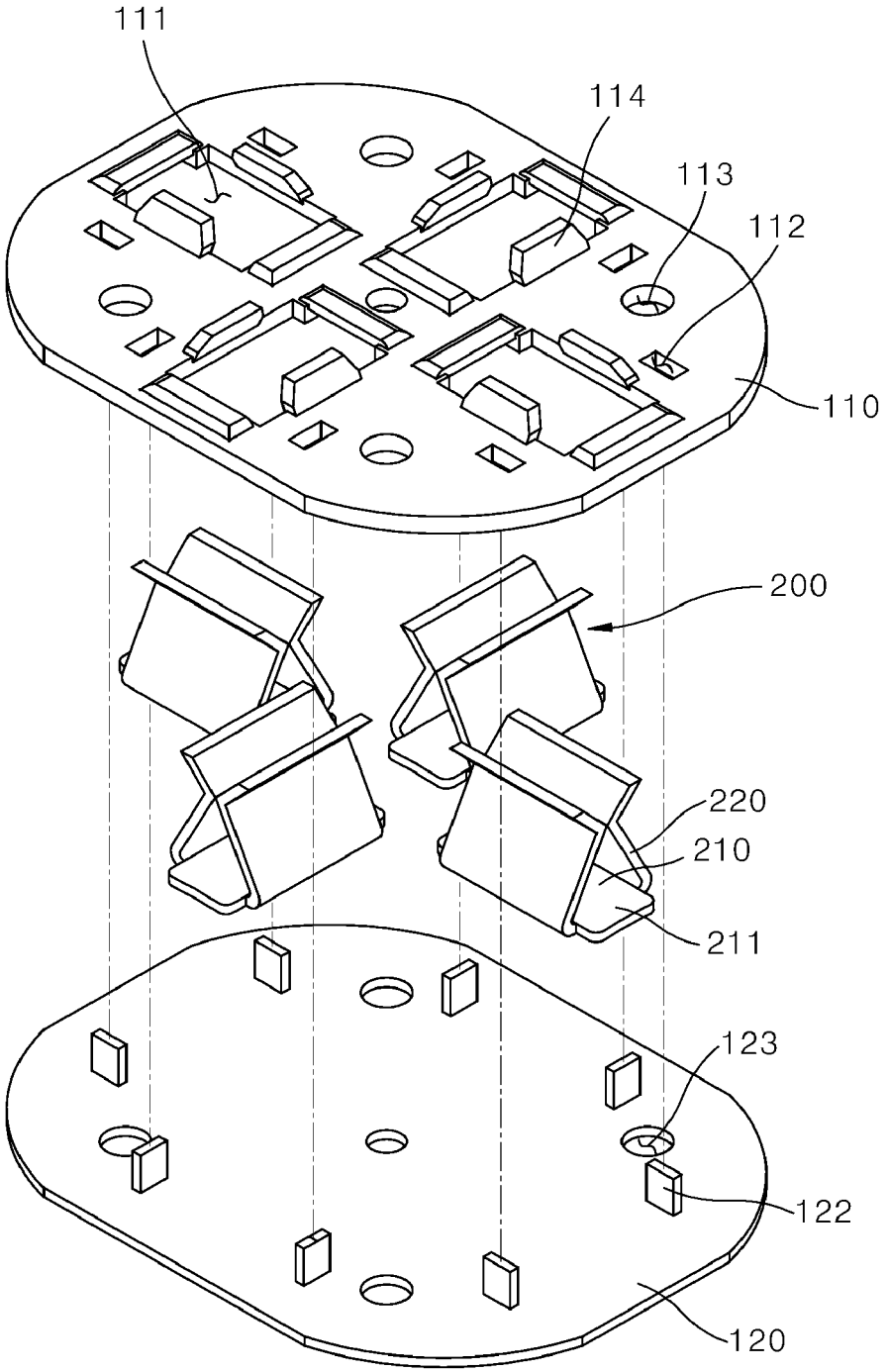
FIG. 3 is an exploded perspective view of the finishing panel fixing device illustrated in FIG. 2.
Figure 4:
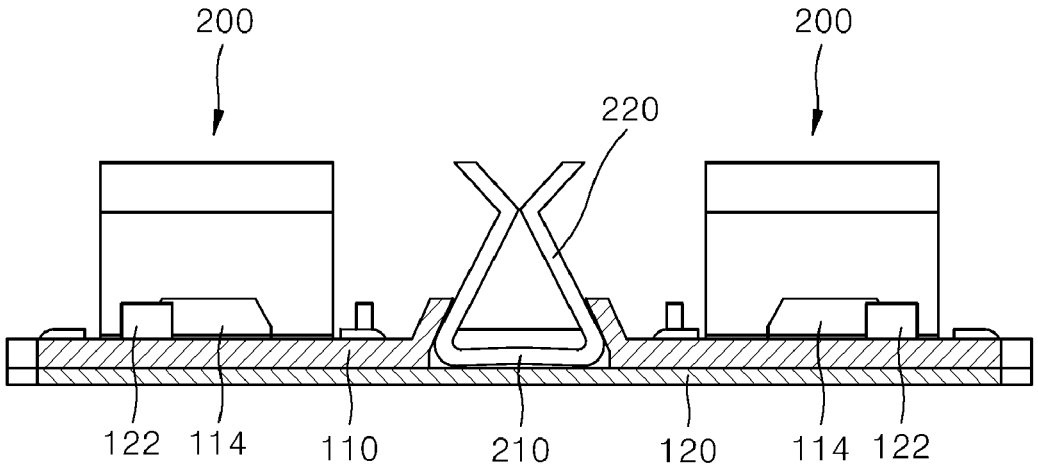
FIG. 4 is a cross-sectional view of the finishing panel fixing device illustrated in FIG. 2.
Figure 5:
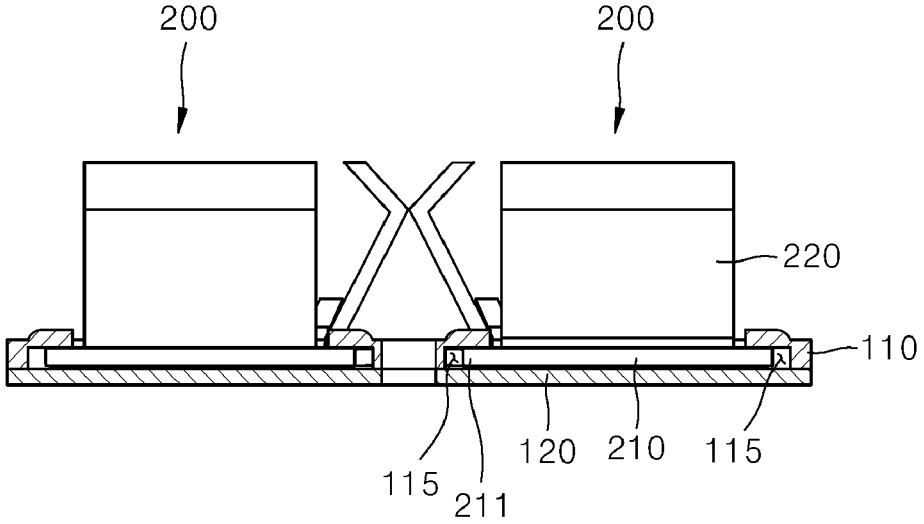
FIG. 5 is a cross-sectional view of the finishing panel fixing device illustrated in FIG. 2.

Hereinafter, a finishing panel fixing device according to one embodiment of the present invention will be described in detail with reference to the accompanying drawings.

In FIGS. 1 to 5 and 11, a finishing panel fixing device 1 according to one embodiment of the present invention is shown. Referring to FIGS. 1 to 5 and 11, the fixing device according to one embodiment of the present invention includes a base 100 and a gripping clip 200.

As shown in FIGS. 1 to 5 and 11, the base 100 is detachably coupled to a support frame 7, which is fixedly installed on a wall 5 or a floor 6 so that finishing panels 3 are installed on the wall 5 or the floor 6, and includes a mounting plate 110 and a reinforcing plate 120.

The base 100 may be inserted inward of the support frame 7 from both sides of a longitudinal direction of the support frame 7 and installed or, unlike this, may enter toward an opening formed in one side of the support frame 7 and be rotated at a predetermined angle for installation.

The mounting plate 110 has a predetermined thickness, is formed in a flat rectangular shape having flat upper and lower surfaces, and has a gently rounded edge.

Further, the mounting plate 110 includes a plurality of mounting holes 111 that pass through upper and lower surfaces of the mounting plate 110 so that the gripping clip 200 described below is inserted from a lower side of the mounting plate 110 toward an upper side thereof and mounted. The mounting holes 111 are formed in a rectangular shape, and as shown in the drawings, inner circumferential surfaces of the mounting holes 111 are formed in a vertical direction to be perpendicular to the upper and lower surfaces of the mounting plate 110.

Figure 6:
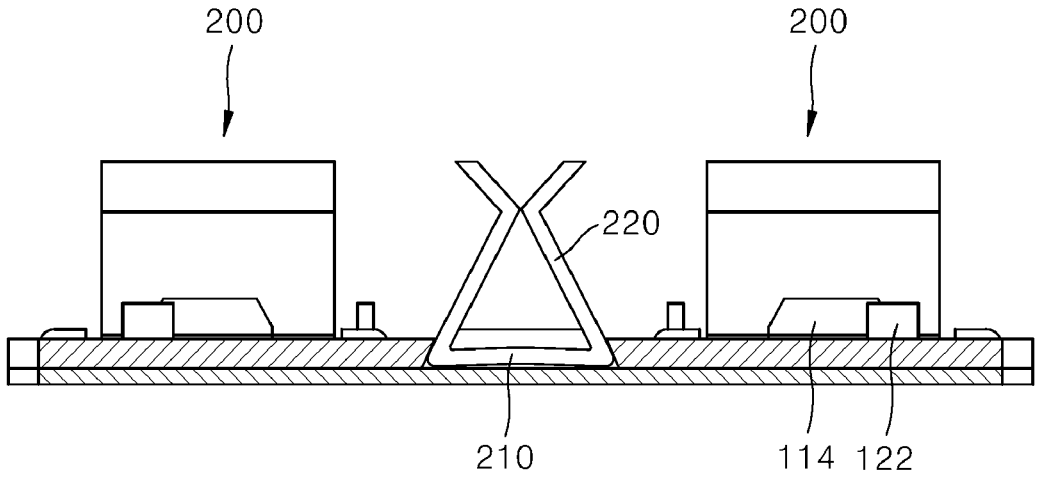
FIG. 6 is a cross-sectional view illustrating a finishing panel fixing device according to another embodiment of the present invention.

Unlike this, as shown in FIG. 6, a width of the inner circumferential surface of the mounting hole 111 is gradually decreased in an upward direction so that the inner circumferential surface comes into contact with outer peripheral surfaces of pressing ribs 220 of the gripping clip 200 described below, but the inner circumferential surface of the mounting hole 111 may have an inclination corresponding to an inclination of the pressing rib 220.

Further, the mounting plate 110 includes a plurality of coupling holes 112 formed around the mounting holes 111 to be coupled with the reinforcing plate 120 to be described below and a plurality of first fixing holes 113 formed to be spaced apart from each other to allow the mounting plate 110 to be fixed to the support frame 7 using a fixing bolt or a fixing piece.

Further, the mounting plate 110 further includes withdrawal preventing protrusions 114 that prevent the gripping clip 200 from being extracted upward from the mounting plate 110. The withdrawal preventing protrusions 114 extend upward from an upper surface of the mounting plate 110 around the mounting holes 111 to be inclined and restrict the pressing ribs 220 of the gripping clip 200.

Further, the mounting plate 110 further includes a withdrawal prevention groove 115 that prevents the gripping clip 200 from being extracted upward from the mounting plate 110. The withdrawal prevention groove 115 is recessed upward from a lower surface of the mounting plate 110 around the mounting holes 111 by a predetermined depth so that a part of the gripping clip 200, specifically a locking protrusion of the gripping clip 200, enters the withdrawal prevention groove 115. The locking protrusion of the gripping clip 200 that enters the withdrawal prevention groove 115 is prevented from moving upward from the mounting plate 110 by the mounting plate 110.

The reinforcing plate 120 is coupled to a lower side of the mounting plate 110 to prevent the gripping clip 200 mounted in the mounting holes 111 of the mounting plate 110 from being extracted downward from the mounting plate 110 so as to support the gripping clip 200, has a predetermined thickness to correspond to an exterior of the mounting plate 110, and has a flat rectangular shape having flat upper and lower surfaces and a gently rounded edge.

Further, the reinforcing plate 120 includes coupling protrusions 122 formed at portions corresponding to the coupling holes 112 of the mounting plate 110 and second fixing holes 123 formed at positions corresponding to the first fixing holes 113 so that a fixing bolt, a fixing piece, or the like passes therethrough.

One side of the gripping clip 200 is coupled to the base 100, and the other side thereof is formed to grip the finishing panels 3. In the embodiment, the gripping clip 200 includes a mounting plate 210 and the pressing ribs 220.

The mounting plate 210 has a size and a shape corresponding to the mounting hole 111, has a rectangular shape of which one side is a long side longer than a short side, and has a thickness smaller than or corresponding to the mounting plate 110.

Further, the pressing ribs 220 extend from both end portions in a width direction of the mounting plate 210 by a predetermined length to increase a distance from the mounting plate 210, are formed to be inclined in a direction in which end portions of the pressing ribs 220 are close to each other, and have bent parts formed at end portions thereof and bent in a direction away from each other so that skirt parts 3*a* of the finishing panels 3 easily enter between the pressing ribs 220.

Further, the base 100 of the finishing panel fixing device 1 according to the present invention further incudes a coupling part for coupling the reinforcing plate 120 with the mounting plate 110.

The coupling part includes a plurality of coupling protrusions 122 that protrude upward from an upper surface of the reinforcing plate 120 and coupling holes 112 that vertically pass through the mounting plate 110 so that the coupling protrusions 122 pass therethrough. Since a length of the coupling protrusion 122 is greater than a thickness of the mounting plate 110, the coupling protrusions 122 pass through the coupling holes 112 and are bent toward one side thereof so that the mounting plate 110 is tightly coupled to the reinforcing plate 120.

As one example of the coupling part, a structure of the coupling protrusions 122 and the coupling holes 112 is applied, but unlike this, a rivet member, a fixing bolt, a fixing piece, or the like may be used for coupling.

Meanwhile, as shown in FIG. 6, when the finishing panel fixing device 1 according to the present invention excludes the withdrawal preventing protrusions 114 and inner circumferential surfaces of the mounting holes 111 have inclinations that correspond to inclinations of the pressing ribs 220, the gripping clip 200 can be prevented from being extracted upward from the mounting plate 110 by the mounting holes 111.

Further, as shown in FIGS. 7 to 10, the base 100 of the finishing panel fixing device 1 according to the present invention may further include an elastic part 130 that elastically supports the gripping clip 200 upward from a lower side of the gripping clip 200 and an elevated part 140 that supports the mounting plate 110 to be spaced apart from the reinforcing plate 120 by a predetermined distance.

Figure 7:
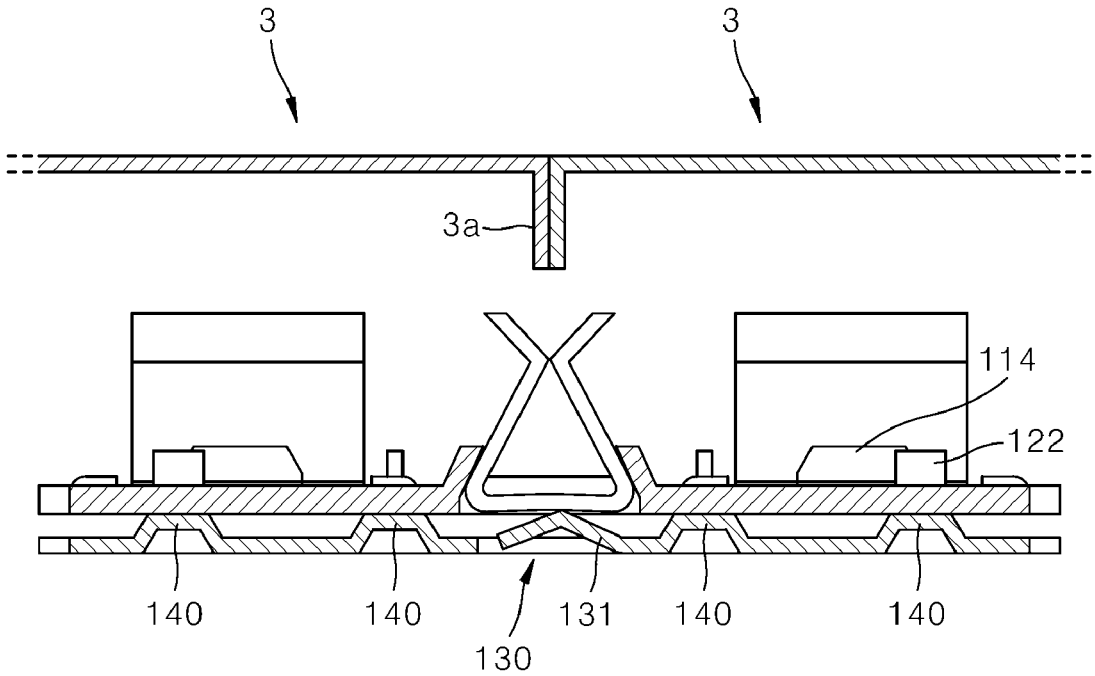
FIG. 7 is a cross-sectional view illustrating an elastic part according to one embodiment of the present invention.
Figure 8:
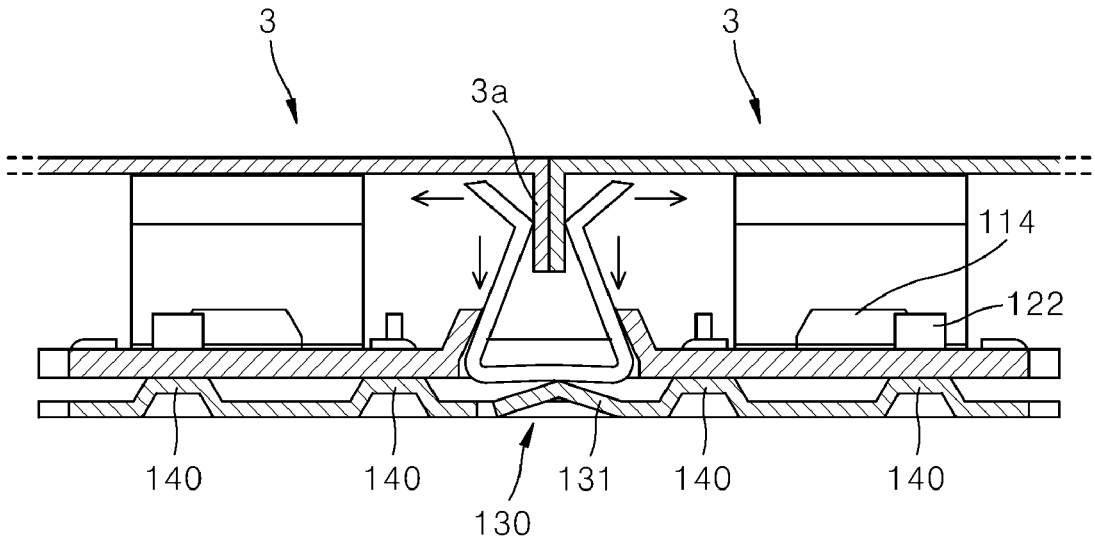
FIG. 8 is a cross-sectional view illustrating operation of the elastic part illustrated in FIG. 7.

As shown in FIGS. 7 and 8, as an example of the elastic part 130, an elastic piece 131 may be applied, wherein the elastic piece 131 is formed by cutting a part of the reinforcing plate 120 disposed below the gripping clip 200 and bending the cut portion upward at a predetermined angle. The elastic piece 131 is bent or curved upward and allows one end portion to vertically vibrate from the other side connected with the reinforcing plate 120.

Further, the elevated part 140 is formed by uplifting a part of the reinforcing plate 120 upward from a lower side of the reinforcing plate 120, and an upper surface of the elevated part 140 is formed flat to be pressed against a lower surface of the mounting plate 110. The above-described coupling protrusions 122 may be formed on an upper surface of the elevated part 140.

As shown in FIG. 8, when the skirt parts 3*a* of the finishing panels 3 enter between the pressing ribs 220 of the gripping clip 200, the above-described structure may prevent the pressing ribs 220 from being bent when a force is concentrated on a part of the pressing ribs 220 at which outer circumferential surfaces of the pressing ribs 220 come into contact with the withdrawal preventing protrusions 114.

That is, the elevated part 140 includes a space part formed between the mounting plate 110 and the reinforcing plate 120 so that the pressing ribs 220 retract to the reinforcing plate 120, and when the pressing ribs 220 are not in contact with the withdrawal preventing protrusions 114, the retracted gripping clip 200 is not restricted by the withdrawal preventing protrusions 114 and is naturally open.

Further, when the gripping clip 200 retracts, the elastic part 130 is bent downward, and when the skirt parts 3*a* of the finishing panels 3 completely enter between the pressing ribs 220, the elastic part 130 presses the gripping clip 200 toward the mounting plate 110 due to elasticity, and thus the gripping clip 200 returns to an original position, that is, into the mounting holes 111, and allows the gripping clip 200 to be continuously positioned in the mounting holes 111 so as to prevent the pressing ribs 220 of the gripping clip 200 from being open.

Figure 9:
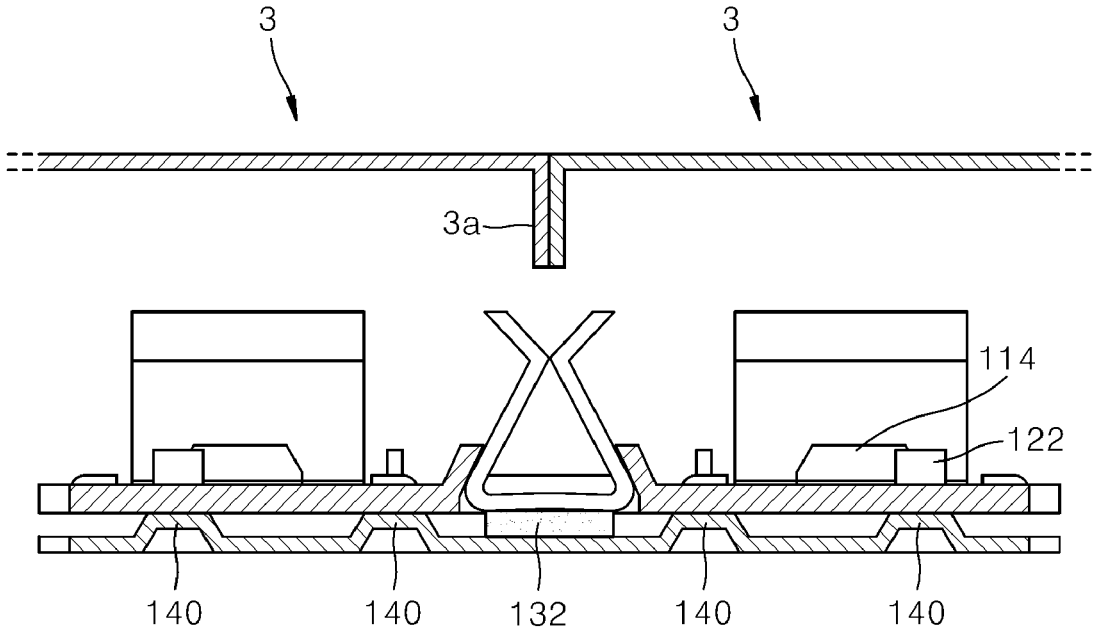
FIG. 9 is a cross-sectional view illustrating an elastic part according to another embodiment of the present invention.
Figure 10:
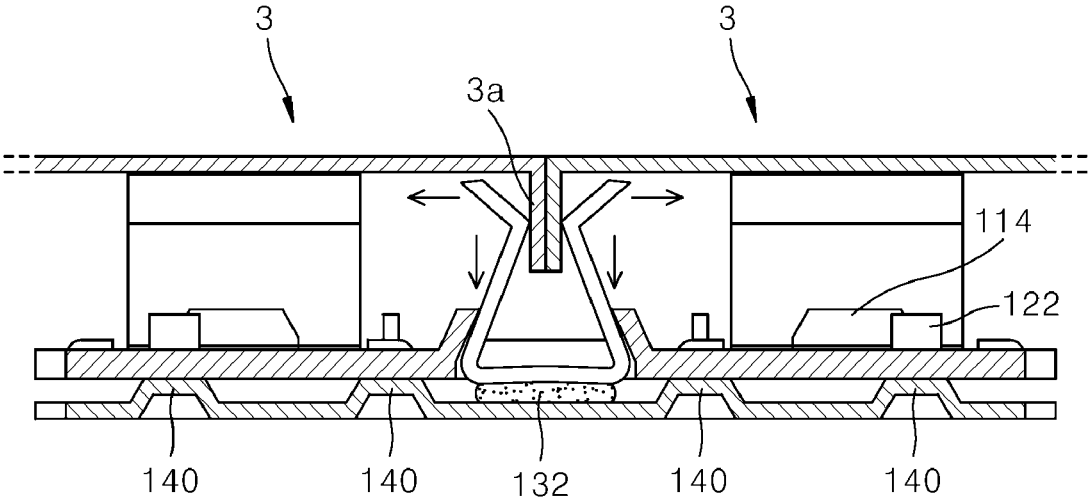
FIG. 10 is a cross-sectional view illustrating operation of the elastic part illustrated in FIG. 9.
Figure 11:
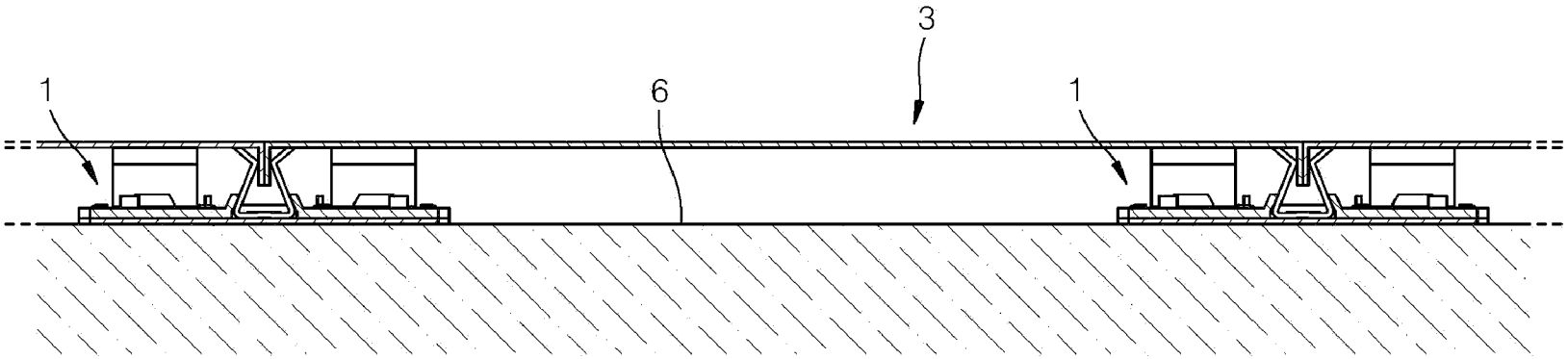
FIG. 11 is a cross-sectional view illustrating an example in which the finishing panel fixing device according to one embodiment of the present invention is used for floor finishing.

As shown in FIGS. 9 and 10, the elastic part 130 may include an elastic part 132 that has a pad form of which the exterior is deformed when an external force is applied and returns to an original state when the external force is removed. The elastic part 132 may be formed of a highly elastic material, wherein, when the skirt parts 3*a* of the finishing panels 3 enter between the pressing ribs 220 of the gripping clip 200, the highly elastic material contracts due to the gripping clip 200 that retracts, and when the skirt parts 3*a* of the finishing panels 3 completely enter between the pressing ribs 220, the highly elastic material is expanded due to elasticity, that is, returns to an original state so as to press the gripping clip 200 toward the mounting plate 110.

Figure 12:
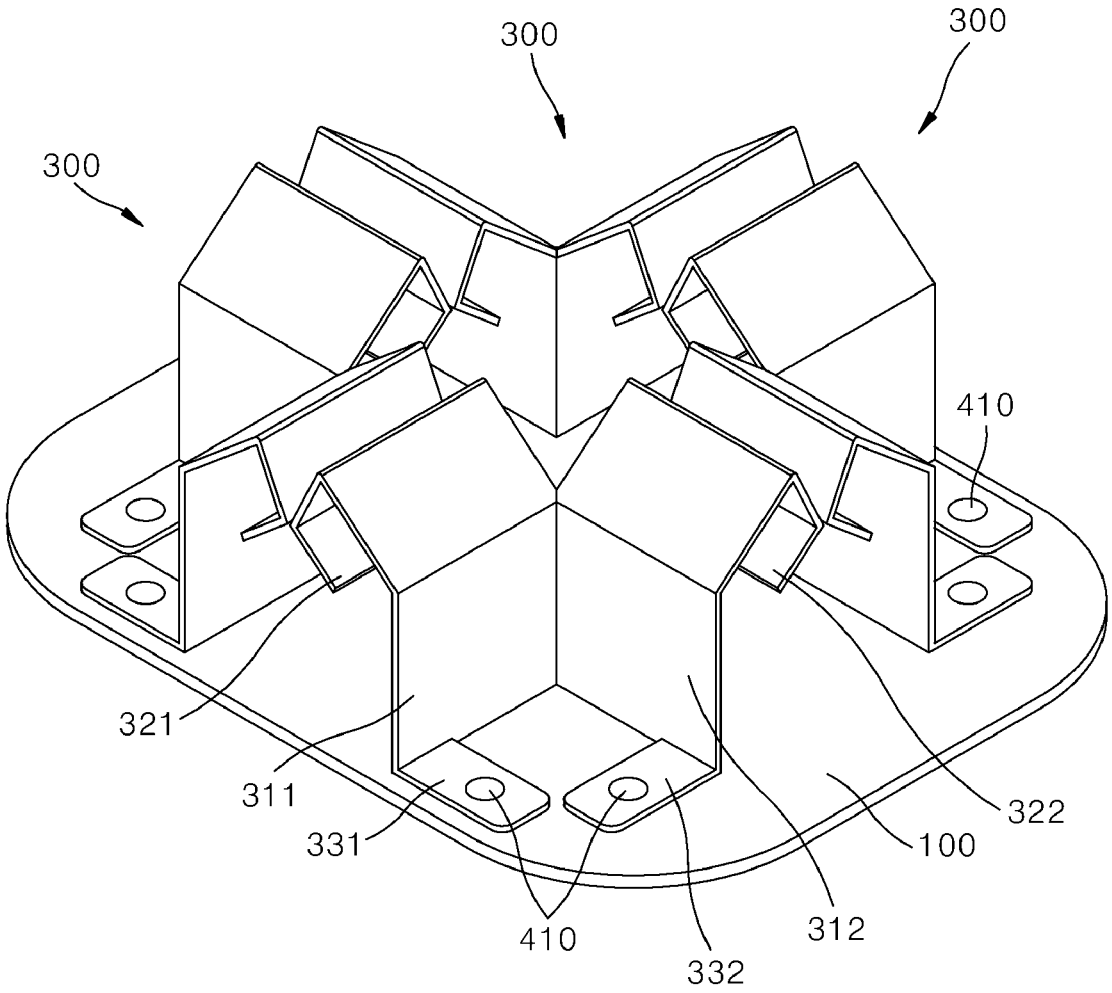
FIG. 12 is a perspective view illustrating a finishing panel fixing device according to still another embodiment of the present invention.
Figure 13:
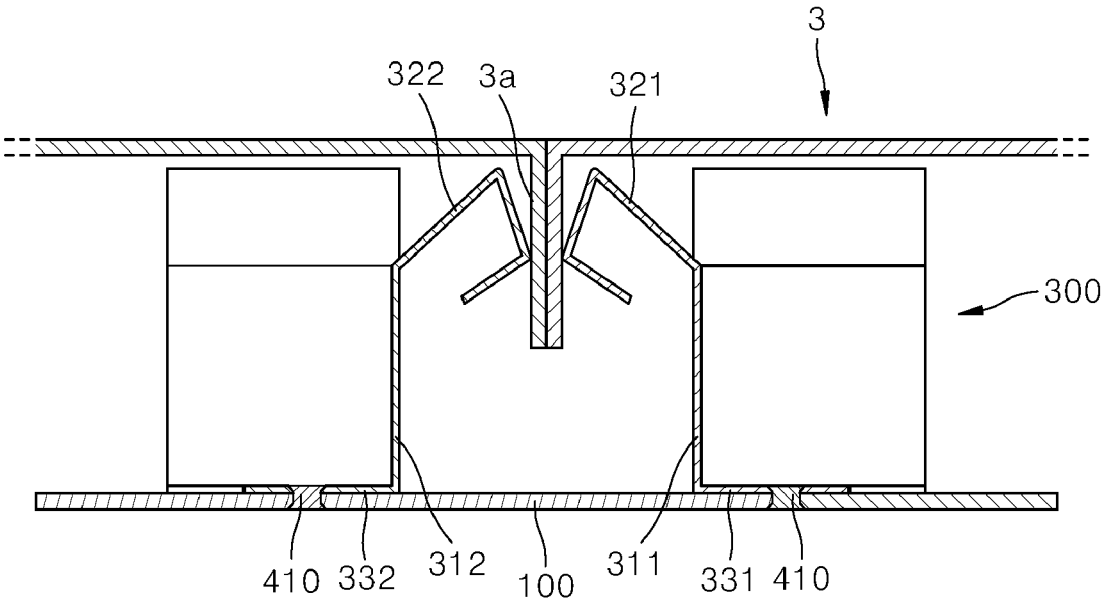
FIG. 13 is a cross-sectional view of the finishing panel fixing device illustrated in FIG. 12.

Meanwhile, a finishing panel fixing device 2 according to another embodiment of the present invention is shown in FIGS. 12 and 13. Referring to FIGS. 12 and 13, the finishing panel fixing device 2 according to the embodiment includes a base 100, gripping clips 300, and a fixing part.

The gripping clips 300 are formed by partially cutting and bending a flat plate with a predetermined area, and the plurality of gripping clips 300 are disposed adjacent to each other in four directions on the base 100.

The gripping clip 300 includes a first vertical part 311 and a second vertical part 312 disposed on the base 100 to be perpendicular to the base 100 and bent to be perpendicular to each other, a first pressing rib 321 and a second pressing rib 322 that extend from upper end portions of the first vertical part 311 and the second vertical part 312 to increase distances from the first vertical part 311 and the second vertical part 312 and press side surfaces of skirt parts 3*a* of finishing panels 3, and a first lateral part 331 and a second lateral part 332 that extend from lower end portions of the first vertical part 311 and the second vertical part 312 to increase distances from the first vertical part 311 and the second vertical part 312 and are supported to be pressed against the base 100.

The first pressing rib 321 of one gripping clip 300 is disposed to face the second pressing rib 322 of the other gripping clip 300 which is adjacent thereto, and the second pressing rib 322 of the one gripping clip 300 is disposed to face the first pressing rib 321 of another gripping clip 300 which is adjacent thereto, and thus both surfaces of the skirt parts 3*a* of the finishing panels 3 are pressed and gripped. That is, the gripping clip 300 cannot grip the skirt parts 3*a* of the finishing panels 3 alone but can grip the skirt parts 3*a* of the finishing panels 3 along with the gripping clip 300 adjacent thereto.

The first pressing rib 321 and the second pressing rib 322 are bent from the first vertical part 311 and the second vertical part 312 several times, respectively, but unlike this, may be bent in a curved form.

The fixing part, which is for fixing the gripping clip 300 to the base 100, includes a fastening member 410 passing through the first lateral part 331 or the second lateral part 332 and fastened with the base 100. A rivet, a fixing bolt, a fixing piece, or the like may be used as the fastening member 410, and in the embodiment, a rivet member having flat upper and lower portions is used.

Meanwhile, as shown in the drawings, the finishing panel fixing device according to the present invention has a structure in which four gripping clips are disposed in four directions perpendicular to each other and fix four finishing panels that are adjacent to each other, but the present invention is not limited thereto. For example, in the finishing panel fixing device according to the present invention, one gripping clip is installed on one base, two gripping clips are installed on one base in a direction in which the two gripping clips are perpendicular to each other or are in parallel, or three gripping clips are installed on one base in a direction in which the three gripping clips are perpendicular to each other.

Further, the base of the finishing panel fixing device according to the present invention may also has a structure in which the base is partially cut from a rectangular shape shown in the drawings due to installation space constraints. That is, while the four gripping clips are mounted on one base, the base is cut in a predetermined direction, and thus the base may be used to be separated into a portion in which three gripping clips are mounted on one base and a portion in which one gripping clip is mounted on one base.

While the finishing panel fixing device according to the present invention has been described above with reference to the accompanying drawings, these are only examples. It may be understood by those skilled in the art that various modifications and equivalent other embodiments may be made. Therefore, the true scope of the technical protection of the present invention should be defined only by the technical spirits of the appended claims.

The invention claimed is:

1. A finishing panel fixing device comprising:

a base coupled to a support frame fixedly installed on a wall or a floor so that a finishing panel is installed on the wall or the floor; and a gripping clip having a first side and a second side, wherein the first side is coupled to the base and the second side serves to grip the finishing panel;

wherein the base includes:

a mounting plate that has a mounting hole vertically passing therethrough so that the gripping clip is inserted thereinto upward from a lower side of the mounting plate and mounted; and a reinforcing plate coupled to the lower side of the mounting plate to prevent the gripping clip from being extracted downward from the mounting plate and supports the gripping clip, wherein the mounting plate includes a withdrawal prevention groove, the withdrawal prevention groove being recessed upward from a lower surface of the mounting plate around the mounting hole to prevent the gripping clip from being extracted upward from the mounting plate and to allow a part of the gripping clip to enter thereinto.

2. The finishing panel fixing device of claim 1, wherein the mounting plate includes a withdrawal preventing protrusion that extends upward from an upper surface of the mounting plate around the mounting hole to be inclined so as to prevent the gripping clip from being extracted upward from the mounting plate and restricts the gripping clip.

3. The finishing panel fixing device of claim 1, wherein the base further includes a coupling part for coupling the reinforcing plate with the mounting plate, wherein the coupling part includes a plurality of coupling protrusions protruding upward from an upper surface of the reinforcing plate and a coupling hole vertically passing through the mounting plate so that each of the coupling protrusions passes therethrough.

4. The finishing panel fixing device of claim 1, wherein the base further includes an elastic part that elastically supports the gripping clip from a lower side of the gripping clip.

5. The finishing panel fixing device of claim 4, wherein the elastic part includes an elastic piece formed by cutting a part of the reinforcing plate disposed below the gripping clip and bending the cut part upward.

6. The finishing panel fixing device of claim 4, wherein the elastic part is deformed when an external force is applied and returns to an original state when the external force is removed.

* * * * *